US008555643B2

(12) United States Patent
Kalina

(10) Patent No.: US 8,555,643 B2
(45) Date of Patent: Oct. 15, 2013

(54) SYSTEMS AND METHODS EXTRACTING USEABLE ENERGY FROM LOW TEMPERATURE SOURCES

(75) Inventor: Alexander I. Kalina, Hillsborough, CA (US)

(73) Assignee: Kalex LLC, Belmont, CA (US)

( * ) Notice: Subject to any disclaimer, the term of this patent is extended or adjusted under 35 U.S.C. 154(b) by 267 days.

(21) Appl. No.: 13/161,379

(22) Filed: Jun. 15, 2011

(65) Prior Publication Data

US 2012/0317983 A1 Dec. 20, 2012

(51) Int. Cl.

| | |
|---|---|
| ***F01K 25/08*** | (2006.01) |
| ***F01K 25/00*** | (2006.01) |
| ***F01K 7/34*** | (2006.01) |
| ***F01K 23/06*** | (2006.01) |
| ***F01K 25/06*** | (2006.01) |

(52) U.S. Cl.

USPC ..... 60/651; 60/671; 60/653; 60/670; 60/649

(58) Field of Classification Search

USPC ..... 60/649, 651, 671, 673

See application file for complete search history.

(56) References Cited

U.S. PATENT DOCUMENTS

| | | | | |
|---|---|---|---|---|
| 4,819,437 | A * | 4/1989 | Dayan | 60/673 |
| 5,649,426 | A * | 7/1997 | Kalina et al. | 60/649 |
| 6,058,695 | A * | 5/2000 | Ranasinghe et al. | 60/39.182 |
| 6,923,000 | B2 * | 8/2005 | Kalina | 60/649 |
| 7,516,619 | B2 * | 4/2009 | Pelletier | 60/649 |
| 7,891,189 | B2 * | 2/2011 | Bottger et al. | 60/649 |
| 2006/0096289 | A1 * | 5/2006 | Kalina | 60/649 |

* cited by examiner

*Primary Examiner* — Thomas Denion
*Assistant Examiner* — Shafiq Mian
(74) *Attorney, Agent, or Firm* — Robert W Strozier

(57) ABSTRACT

Simple thermodynamic cycles, methods and apparatus for implementing the cycles are disclosed, where the method and system involve once or twice enriching an upcoming basic solution stream, where the systems and methods utilize relatively low temperature external heat source streams, especially low temperature geothermal sources.

22 Claims, 4 Drawing Sheets

SYSTEMS AND METHODS EXTRACTING USEABLE ENERGY FROM LOW TEMPERATURE SOURCES

BACKGROUND OF THE INVENTION

1. Field of the Invention

Embodiments of the present invention relate to methods and systems for converting thermal energy from low temperature sources, especially from low temperature geothermal sources, into mechanical and/or electrical energy.

More particularly, embodiments of the present invention relate to methods and systems for converting thermal energy from low temperature sources, especially from low temperature geothermal sources, into mechanical and/or electrical energy, where a working fluid comprises a mixture of at least two components. In certain embodiments the working fluid comprising a water-ammonia mixture. Embodiments of the present invention also relate to novel thermodynamic cycles or processes and systems to implement them.

2. Description of the Related Art

Prior art methods and systems for converting heat into useful energy at well documented in the art. In fact, many such methods and systems have been invented and patented by the inventor. These prior art systems include U.S. Pat. Nos. 4,346,561, 4,489,563, 4,548,043, 4,586,340, 4,604,867, 4,674,285, 4,732,005, 4,763,480, 4,899,545, 4,982,568, 5,029,444, 5,095,708, 5,440,882, 5,450,821, 5,572,871, 5,588,298, 5,603,218, 5,649,426, 5,822,990, 5,950,433; 5,593,918; 6,735,948; 6,769,256; 6,820,421; and 6,829,895; incorporated herein by reference.

Although all of these prior art systems and methods relate to the conversion of thermal energy into other more useful forms of energy from moderately low temperature sources, all suffer from certain inefficiencies. Thus, there is a need in the art for an improved, economically systems and methods for converting thermal energy from moderately low temperature sources to more useful forms of energy, especially for converting geothermal energy from moderately low temperature geothermal streams into more useful forms of energy.

SUMMARY OF THE INVENTION

Embodiments of the thermodynamic cycles of this invention provide a basic solution stream having a relatively lean composition (an increased amounts of the higher boiling components of the multi-component working fluid). The relatively lean composition of the basic solution allows for a lower pressure environment for condensation of the basic solution stream in a condenser or first heat exchange unit using an external coolant at ambient temperature. A fully condensed basic solution stream is pressurized and then enriched once with a first rich saturated vapor stream from a third separator. The once enriched stream is the pressurized again and enriched a second time with a second rich saturated vapor stream from a second separator. The twice enriched stream is then pressurized a third time before entering a second heat exchange unit, where it is heated and partially vaporized by a cooled external heat source stream to from a partially vaporized twice enriched stream. The partially vaporized twice enriched stream is then forwarded to a first separator to form a third rich vapor stream, which is forwarded into a superheater or third heat exchange unit, where it is superheated. The superheated third rich vapor stream is then forwarded into a turbine assembly, where a portion of its thermal energy is converted into a useable form of energy (mechanical and/or electrical) to form a spent stream. The first separator also produces a first lean liquid stream, which is passed through a first throttle valve to produce a first reduced pressure mixed liquid-vapor stream, which is fed to the second separator to produce the second rich vapor stream and a second lean liquid stream. The second lean liquid stream is passed through a second throttle valve to produce a second reduce pressure mixed liquid-vapor stream, which is then fed into the third separator to produce the first rich vapor stream and the a third lean liquid stream. The third lean liquid stream is then passed through a third throttle valve to produce a third reduced pressure mixed liquid-vapor stream. The third reduced pressure mixed liquid-vapor stream is then mixed with the spent stream to form the basic solution stream prior to the basic solution stream entering the condenser or first heat exchange unit. As a result of this two stage enrichment process, the quantity of vapor produced in the second heat exchange unit and then separated in the first gravity separator forming the third rich vapor stream, which is substantially increased as compared to the quantity of vapor which could have been produced if the basic solution of the streams was directly vaporized in the second heat exchange unit. This two stage enrichment process increases the overall efficiency of the system. Additionally, each enriching vapor stream is capable of being fully absorbed by its corresponding liquid stream. In summary, the recuperation of the energy potential of the lean liquid stream produced in the first separator is used twice, to enrich the upcoming basic solution stream and also to heat the same upcoming stream through the absorption of the enriching vapor stream.

In certain embodiment, the quantity of the first enriching vapor stream is too small to be of use. In such a case, a simplified version of the system may be implemented. The simplified version has the principle of operation, but in the simplified version, the first lean liquid stream is throttled only once, eventually producing a single enriching vapor stream exiting from a second separator. In this case, the efficiency and power output of the simplified system are only slightly lower than in the full system. The simplified system includes one less separator, one less pump, and one less throttle valve.

Embodiments of the present invention provide methods for implementing a thermodynamic cycle comprising expanding a super heated third vapor stream and transforming its thermal energy into usable form of energy (mechanical and/or electrical) producing a low pressure spent stream. After expansion, the spent stream is mixed with a third mixed liquid-vapor stream forming a basic solution stream. The basic solution stream is the fully condensed in a condenser or first heat exchange unit using an external coolant at ambient temperature. The fully condensed basic solution stream is then pressurized to form a pressurized basic solution stream. The pressurized basic solution stream is them mixed with a first saturated vapor stream to form a first or once enriched stream, where the pressurized basic solution is capable of fully absorbing the first saturated vapor stream. The first enriched stream is then pressurized to form a pressurized first enriched stream, which is them mixed with a second saturated vapor stream to form a second or twice enriched stream. The pressurized first enriched stream is capable of fully absorbing the second saturated vapor stream. The twice enrich stream is then pressurized to form a pressurized twice enrich stream, which is then forwarded to a second heat exchange unit, where the pressurized twice enrich stream is heated and partially vaporized with heat from a cooled external heat source stream. The partially vaporized, pressurized twice enrich stream is then forwarded to a first gravity separator. In the first separator, the partially vaporized, pressurized twice enrich stream is separated into a third saturated vapor stream and a lean liquid stream. The third saturated vapor stream is then forwarded to a third heat exchange unit, where the third saturated vapor stream is fully vaporized and superheated with heat from a hot external heat source stream to form a fully vaporized and superheated stream and the cooled external heat source stream. The first lean liquid stream is then passed through a first throttle valve to form a first reduced pressure mixed liquid-vapor stream. The first mixed liquid-vapor stream is then fed into a second separator to produce the second rich saturated vapor stream and a second lean liquid stream. The second lean liquid stream is then passed through a second throttle valve to form a second reduced pressure mixed-liquid stream, which is then fed into a third separator producing the first saturated vapor stream and the third lean liquid stream. The third lean liquid stream is then passed through a third throttle valve to from the third reduce pressures mixed liquid-vapor stream. Thus, the full method and system produces three saturated vapor streams, three lean liquid streams, three pressurized upcoming streams and three reduced pressure mixed liquid-vapor streams. In the simplified version, one separator, one pump and one throttle control valve are removed reducing the streams to two—two saturated vapor streams, two lean liquid streams, two pressurized upcoming streams and two reduced pressure mixed liquid-vapor streams.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
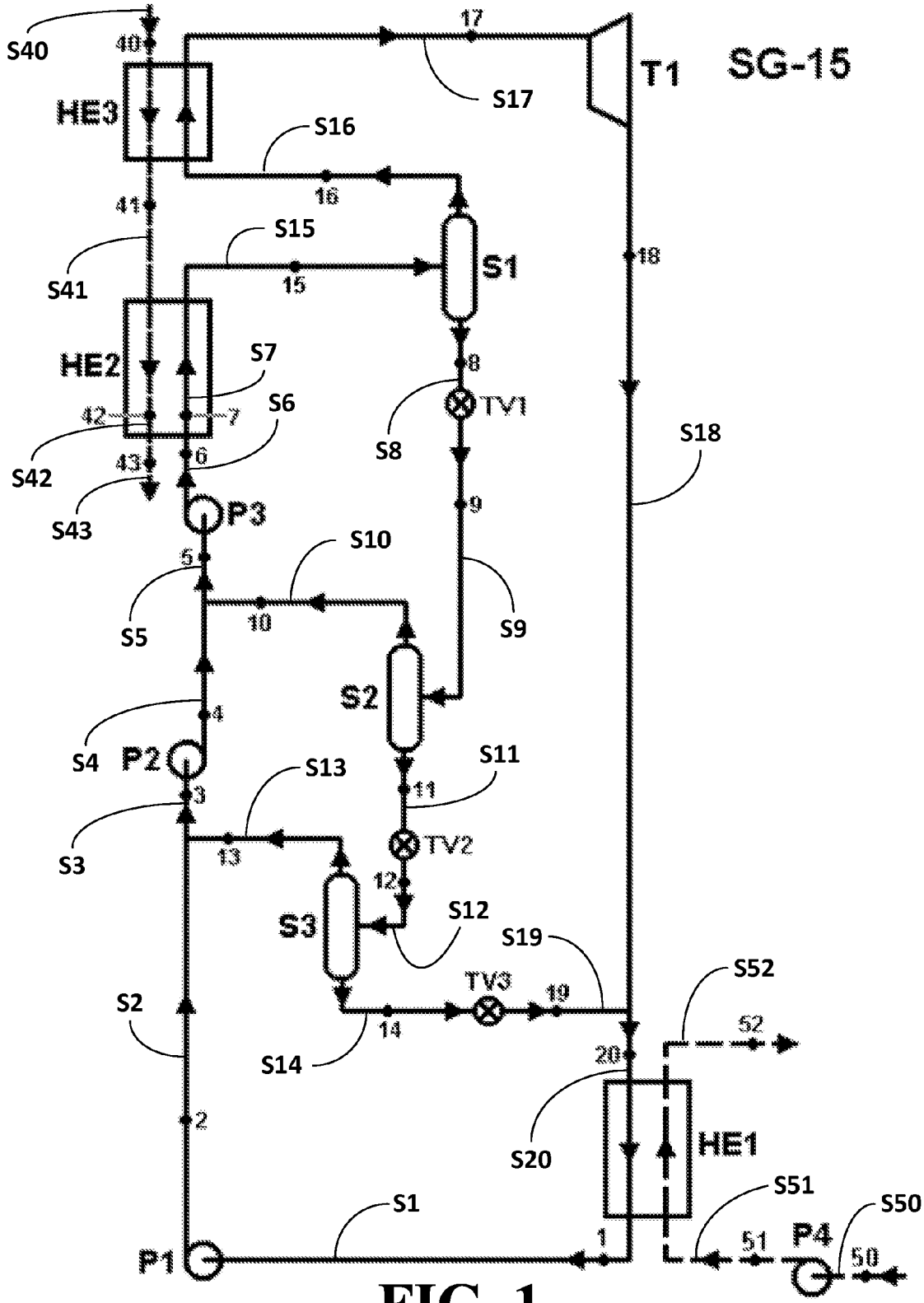
FIG. 1 depicts a diagram of an embodiment of a system and method of this invention for converting heat from a geothermal source to a useful form of energy.

The inventor has found that a system utilizing a simply thermodynamic cycle (process) can be designed to efficiently and cost effectively utilize low temperature heat source streams to generate mechanical and/or electrical power. The systems and processes or methods use a multi-component working fluid comprising at least one lower boiling point component and at least one higher boiling point component. The systems and methods of this invention are simplified for converting heat from relatively low temperature heat sources such as geothermal sources into a more useful form of energy. The systems and methods may extract energy from one or more (at least one) heat source stream, especially geothermal source streams. The systems of this invention include at least two gravity separators, a turbine assembly and three heat exchange units (two for vaporizing and superheating a upcoming stream) and one for condensing a basic solution stream. The systems also including control valves, mixing valves and piping needed to implement the methods of this invention.

In one embodiment, a basic solution stream comprising a relatively lean mixture of the components of the multi-component working fluid allows for a lower pressure condensation of the basic solution stream using an external coolant at a given ambient temperature. The upcoming basic solution of undergoes at least two pressurization stages and is enriched at least once by mixing with rich saturated vapor stream from a separator. As a result, the composition of the stream entering a heat exchange unit that partially vaporizes the stream is enriched. The stream enrichment (higher concentration of the lower boiling components that the basic solution) allows an increase of pressure at which boiling of the enriched stream occurs in the heat exchange unit.

In the embodiments where the upcoming stream is enriched twice, the quantity of vapor produced in the heat exchange unit and then separated in a gravity separator forming a saturated vapor stream is substantially increased as compared to the quantity of vapor which could have been produced in the basic solution stream would have been subjected to boiling in the heat exchange unit. This two stage enrichment process increases the overall efficiency of the system. The saturated vapor stream is then fully vaporized and slightly superheated in another heat exchange unit.

In some cases, the quantity of the second enriching vapor stream is too small to be of use. In such a case, a simplified version of the system may be implemented. The simplified version operates on the overall principle, but in the simplified version, the first liquid stream is throttled only once, eventually producing a single enriching vapor stream exiting from the enriching separator. In this case, the efficiency and power output of the simplified system are only slightly lower than in the full system.

The working fluids used in the systems and methods of this invention are multi-component fluids that comprise at least one lower boiling point component—the lower boiling component—and at least one higher boiling point component—the higher boiling component. In certain embodiments, the working fluids comprise an ammonia-water mixture, a mixture of two or more hydrocarbons, a mixture of two or more freon, a mixture of hydrocarbons and freon, or the like. In general embodiments, the fluid may comprise mixtures of any number of components with favorable thermodynamic characteristics and solubility. In other embodiments, the fluid comprises a mixture of water and ammonia.

SG-15 AND SG-16

Embodiments of the present invention relates to the process and system for the conversion of thermal energy into mechanical and/or electrical power. Embodiments of the present system is designed to utilize heat sources with a relatively low initial temperature of less than or equal to 400° F. The present systems are intended for relatively small-scale power applications, such that low capital cost and simplicity justly a somewhat lower than maximum possible efficiency.

Embodiments of the present system use a mixture of at least two components, with different normal boiling temperatures, as a working fluid.

SG-15 operates as follows:

A stream S1 of a basic solution having parameters as at a point 1, designated the default solution of a multi-component working fluid having been fully condensed in a first heat exchange unit HE1 at ambient temperature is pumped to an intermediate pressure by a first pump P1 to form a higher pressure basic solution stream S2 having parameters as at a point 2. The parameters of the stream S2 correspond to a state of subcooled liquid.

The stream S2 is then mixed with a rich saturated vapor stream S13 having parameters as at a point 13. The parameters of the stream S13 comprises a high concentration of the lower boiling components as described below. The pressure at which this mixing occurs is chosen in such a way that the stream S2 fully absorbs the stream S13 to form a stream S3 having parameters as at a point 3. The parameters of the stream S3 conform to a composition having a higher concentration of the lower boiling components than the basic solution and is designated an enriched solution, which is in a state of saturated or slightly subcooled liquid.

The stream S3 is now sent into a feed or second pump P2, where its pressure is increased to form a higher pressure stream S4 having parameters as at a point 4. The parameters of the stream S4 corresponding to a state of subcooled liquid.

The stream S4 is now mixed with a saturated vapor stream S10 having parameters as at a point 10. Again, as a result of such mixing, the stream S10 is fully absorbed by the stream S4, forming a stream S5 having parameters as at a point 5. The parameters of the stream S5 corresponding to a state of saturated or slightly subcooled liquid and is a further enriched solution, designated a rich solution.

The stream S5 is now sent into a third pump P3, where its pressure is further increased, to a desired higher pressure to form a higher pressure stream S6 having parameter as at a point 6. The parameters of the stream S6 correspond to a state of subcooled liquid. The stream 6 is now sent into a second heat exchange unit HE2, where it heated in counterflow with a heat source liquid stream having parameters as at a point 41 in a second heat exchange process 41-43 or 6-15 as described below. The stream S6 is partially vaporized in the second heat exchange unit HE2. Initially, the stream S6 is heated to form an initially heated stream S7 having parameters as at a point 7. The parameters of the stream S7 correspond to a state of saturated liquid. Thereafter, the stream S7 boils to form a partially vaporized, rich solution stream S15 having parameters as at point a 15. The parameters of the stream S15 corresponds to a state of vapor-liquid mixture.

The stream S15 is now sent into a first gravity separator S1, where it is separated into a saturated vapor stream S16 having parameters as at a point 16 and a saturated liquid stream S8 having parameters as at a point 8.

The stream S8 is now sent into a first throttle valve TV1, where its pressure is reduced to a pressure equal to a pressure of the stream S4 having the parameters as at the point 4 as described above to form a reduced pressures stream S9 having parameters as at a point 9 corresponding to a state of liquid-vapor mixture.

The stream S9 is now sent into a second gravity separator S2, where it is separated into a saturated liquid stream S11 having parameters as at a point 11, and a saturated vapor stream S10 having the parameters as at the point 10 as described above. The stream S10 is then mixed with the stream S4 as described above.

Meanwhile, the stream S11 is now sent into a second throttle valve TV2, where its pressure is reduced to a pressure equal to the pressure of the stream S2 having the parameters as at the point 2 forming a stream S12 having parameter as at a point 12, corresponding to a state of vapor-liquid mixture.

The stream S12 now enters into a third gravity separator S3, where it is separated into a saturated liquid stream S14 having parameters as at a point 14 and the saturated vapor stream S13 having parameters as at the point 13. The stream S13 is then mixed with the stream S2 as described above.

The stream S11 exiting from the second gravity separator S2 is leaner than the stream S9 entering the gravity separator S2. The stream S14 exiting the third gravity separator S3 is, in turn, leaner than the stream S12 entering the third separator S3.

Meanwhile, the stream S16, the higher pressure vapor stream exiting the first gravity separator S1, enters into a third heat exchange unit or superheater unit HE3, where it is slightly superheated in counterflow with the heat source liquid stream S40 having parameters as at a point 40 in a third heat exchange process 40-41 or 16-17 forming a superheated stream S17 having parameters as at a point 17 and a cooled heat source liquid stream S41 having parameters as at the point 41.

The stream S17 is then sent into a turbine T1, where it is expanded, producing work, forming a spent stream S18 having parameters as at a point 18, usually corresponding to a state of wet vapor.

Meanwhile, the steam S14 is sent through a third throttle valve TV3, where its pressure is reduced to a pressure equal to the pressure of the stream S18 having the parameters as at the point 18, forming a reduced pressure stream S18 having parameters as at a point 19.

The stream S19 is now mixed with the stream S18 as described above forming a basic solution stream S20 having parameters as at a point 20, corresponding to a state of vapor-liquid mixture.

The stream S20 is now sent through a first stream or condenser HE1, where it cooled in counterflow by a coolant stream S51 (water or air) in a first heat exchange process 51-52 or 20-1 to form a spent coolant stream S52 having parameters as at a point 52. The stream S20 is fully condensed to form the fully condensed basic solution stream S1 having the parameters as at the point 1, corresponding to a state of fully condensed saturated liquid as described above.

The cycle is closed.

In the case that water is used as the coolant, it is circulated by a water pump P4. The coolant stream S50 enters the water pump P4 having parameters as at a point 50 and exits the water pump P4 having the parameters as at the point 51.

In the case that air is used as the coolant, then the coolant stream S51 having the parameters as at the point 51 has parameters as ambient atmospheric air. The circulation of air is performed by a suction pump installed after the point 52 (not show.)

In the cycle of FIG. 1, the basic solution is relatively lean providing for a lower pressure for the condensation of the stream S20 at a given ambient temperature. The basic solution of the streams S1 and S2 having the parameters as at the points 1 and 2 is enriched twice by mixing with rich saturated vapor streams S13 and S10 from the separators S3 and S2, respectively. As a result, the composition of the working fluid which enters into the second heat exchange unit HE2 is enriched, which allows an increase of pressure at which boiling of the stream S6 occurs in second heat exchange unit HE2.

As a result of this two stage enrichment process, the quantity of vapor produced in the second heat exchange unit HE2 and then separated in the gravity separator S1 forming the stream S16 having the parameters as at the point 16, is substantially increased as compared to the quantity of vapor which could have been produced in the basic solution of the streams S1 and S2 having the parameters as at the points 1 and 2, if the stream S2 would have been subjected to boiling in the second heat exchange unit HE2. This two stage enrichment process increases the overall efficiency of the system.

In the prior art system disclosed in U.S. Pat. No. 5,953,918 (designated KCS-34), the liquid from the gravity separator, analogous to the separator S1, was cooled and the heat released was recuperated by an upcoming stream of a basic solution. In the present system, in contrast, the analogous stream of liquid, the stream S8, is throttled and used to enrich of the upcoming stream of the basic solution stream S2.

However, in this process of enrichment, the upcoming stream S2-S3-S4 absorb the released vapor streams S13 and S10 and as a result are not only enriched but also heated at the same time.

In summary, the recuperation of the energy potential of the stream S8 is used twice, to enrich the upcoming streams S2-S3-S4 and also to heat the same upcoming stream.

Figure 2:
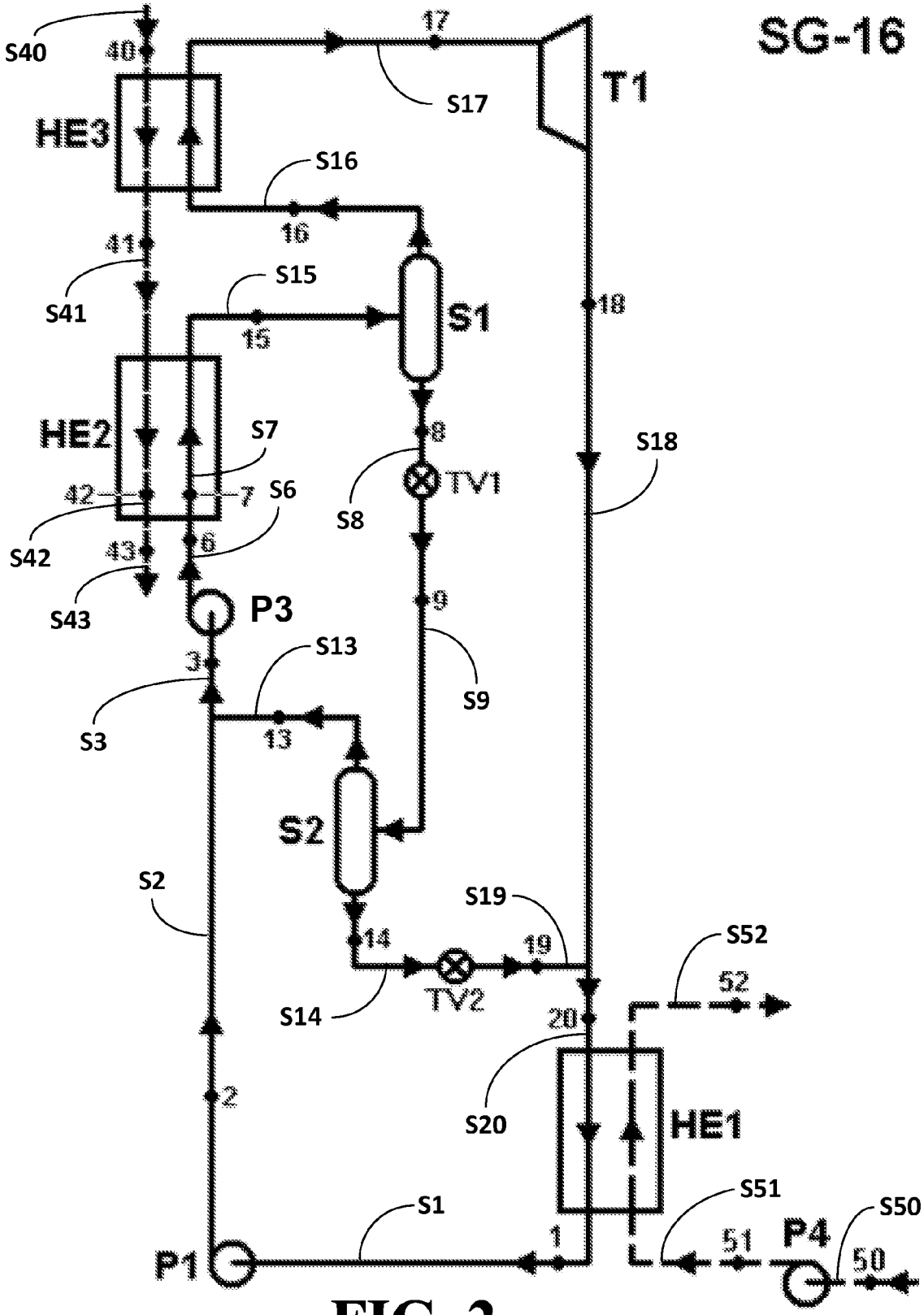
FIG. 2 depicts a diagram of another and simpler embodiment of a system and method of this invention for converting heat from a geothermal source to a useful form of energy.

In some cases, the quantity of the enriching vapor stream S13 released into the stream S3 is too small to be of use. In such a case, a simplified version of the system SG-16 may be implemented. The simplified version is designated SG-15 and is shown in FIG. 2. The principle of operation is the same, but in the simplified version SG-15, the liquid stream S8 is throttled only once, eventually producing a single enriching vapor stream S13 exiting from the separator S2.

In this case, the efficiency and power output of the system SG-16 are only slightly lower than in the full system SG-15 as shown in FIG. 1.

One experienced in the art can choose to utilize the initial or the simplified version of the embodiments of systems and methods of this invention depending on technical and economic considerations.

The present systems are both more efficient and simpler than the system described in U.S. Pat. No. 5,953,918 (KCS-34).

The present systems are somewhat less efficient than the system described in U.S. Pat. No. 6,769,256 (SG-2), but the present systems are substantially simpler than SG-2 and will have lower capital costs.

A comparison of output of the proposed system, compared to systems described in the prior art, is given below:

| System | Output* |
|---|---|
| KCS-34 | *2861.68 kWt |
| SG-2a** | *3351.91 kWt |
| SG-16 | *2980.71 kWt |

*Assuming a heat source of geothermal brine with an inlet temperature of 230° F., an outlet temperature of 119° F. and a flow rate of 1,000,000 lb/hour at ISO ambient conditions
**SG-2a is disclosed in U.S. Pat. No. 6,769,256

Moreover, the system of the present invention may be skid mounted having an inlet fitting and an outlet fitting for circulating a low temperature heat source stream through the heat exchange units HE2 and HE3 of the systems and an input fitting and an output fitting for circulating a coolant stream through the heat exchange unit HE1.

Figure 3A:
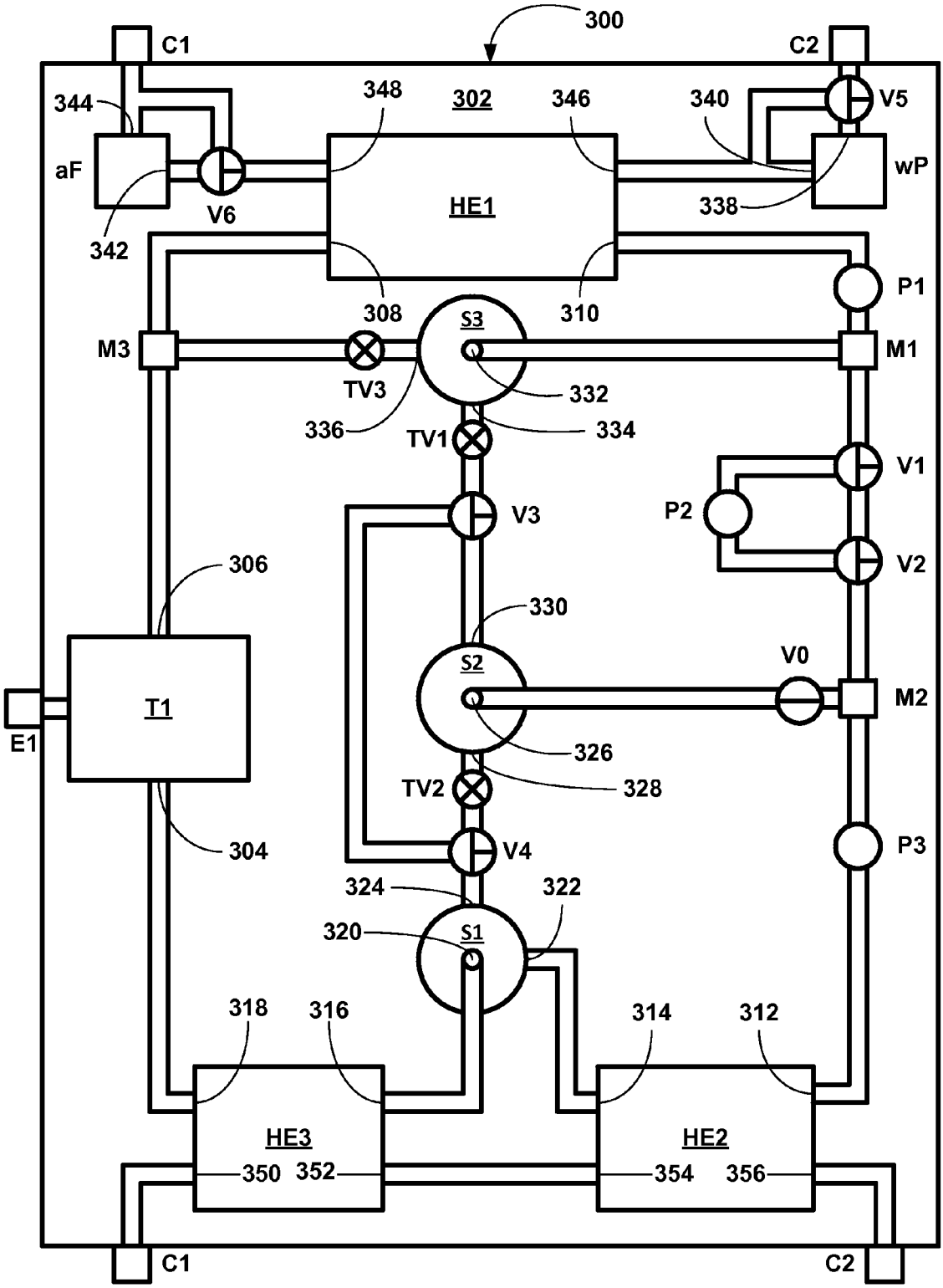
FIG. 3A depicts an embodiment of a skid mounted system of this invention.
Figure 3B:
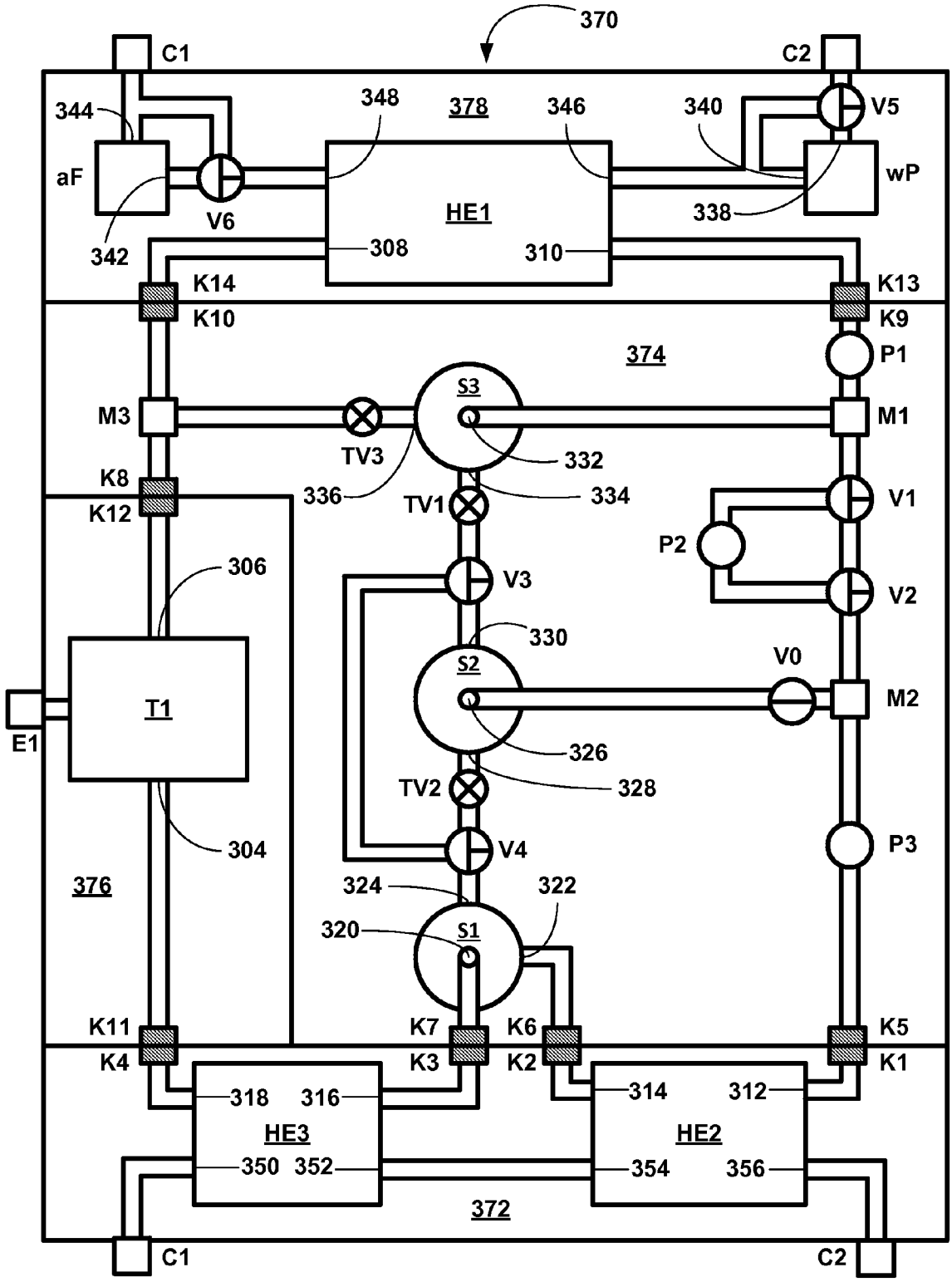
FIG. 3B depicts another embodiment of a skid mounted system of this invention.

Referring now to FIG. 3A, an embodiment of a skid mounted system, generally 300, is shown to include a turbine unit T1, three heat exchange units HE1, HE2 and HE3, three gravity separators S1, S2, and S3, four fluid connectors C1, C2, C3 and C4, one electrical connection E1, three pumps P1, P2, and P3, one water pump wP, one air fan aF, three mixing valve M1, M2 and M3, three throttle valve TV1, TV2, and TV3, and one two way valve V0, six three way valves V1, V2, V3, V4, VV65 and V6 all mounted on a skip 302. The system 300 also include piping interconnecting the various components as shown and a turbine inlet 304, a turbine outlet 306, a first heat exchange unit inlet 308, a first heat exchange unit outlet 310, a second heat exchange unit inlet 312, a second heat exchange unit outlet 314, a third heat exchange unit inlet 316, a third heat exchange unit outlet 318, a first separator top port 320, a first separator middle port 322, a first separator bottom port 324, a second separator top port 326, a second separator middle port 328, a second separator bottom port 330, a third separator top port 332, a third separator middle port 334, a third separator bottom port 336, a water pump inlet 338, a water pump outlet 340, an air fan inlet 342, an air fan outlet 344, a coolant inlet 346, a coolant outlet 348, a hot external heat source stream inlet 350, a cooled external heat source stream outlet 352, a cooled external heat source stream inlet 354 and a spent external heat source stream outlet 356. The skid configuration 300 is designed to implement either the fully version or simplified version of the methods of this invention. Thus, by controlling the valves V0, V1, V2, V3, and V4, the pump P2, the second throttle valve TV2, and the second separator S3 can either be by-passed or included, which effectively and efficiently switches the configuration between SG-15, the fully system and method, and SG-16, the simplified system and method. Although the skid of FIG. 3A is shown as a single unit, it should be recognized that the system may be segregated into several subunits, generally 370, as shown in FIG. 3B. This embodiment includes a first skip 372 having mounted thereon a vaporizing and superheating subunit including heat exchanges units HE2 and HE3, the fluid connectors C1 and C2, and fluid couplings K1, K2, K3, and K4 and associated piping. A second skip 374 having mounted thereon a separation subsystem including the three separators S1, S2, and S3, the three throttle valve TV1, TV2 and TV3, the pumps P1, P2, and P3, the valves V0, V1, V2, V3 and V4, and the mixing valves M1, M2 and M3, fluid couplings K5, K6, K7, K8, K9, and K10 and associated piping. A third skip 376 having mounted thereon a turbine subsystem including a turbine T1, the electrical connector E1, fluid coupling K11 and K12 and associated piping and electric cables. And a fourth skip 378 having mounted thereon a condenser subsystem including the condenser HE1, the valves V5 and V6, the water pump wP, the air fan aF, and fluid couplings K13 and K14 and associated piping. The system 300 and the condenser subsystem includes the two valves V5 and V6, the water pump wP and the air fan aF may be configures so that the system can be use either water or air as the coolant. The fluid coupling K1-K14 are adapted to provide a quick interconnection mechanism for connecting the skids 372, 374, 376 and 378 together. These coupling can be traditional fitting or quick connect fitting as is well known in the art. As shown, couplings K1-K3 and K5-K7 couple the skid 372 and the skid 374. The couplings K4 and K11 couple the skid 372 and 376. The coupling K8 and K12 couple the skid 376 and 374. The coupling K9-K10 and K13-K14 couple the skip 374 and the skip 378. The valving can also be computer controlled valves and the system can include a computer for controlling the valves so that the skid system can be switched between the fully version and the simplified version.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A method for implementing a thermodynamic cycle comprising:

expanding a fully vaporized and superheated third saturated vapor stream, transforming a portion of thermal energy into a usable form in a turbine assembly to form a spent stream;

mixing the spent stream with a third reduced mixed liquid-vapor stream to form a basic solution stream, condensing the basic solution stream in a condenser or first heat exchange unit using an external coolant to form a fully condensed basic solution stream, pressurizing the fully condensed basic solution stream to form a pressurized basic solution stream, mixing the pressurized basic solution stream with a first saturated vapor stream to form a first or once enriched stream, where the pressurized basic solution stream fully absorbs the once saturated vapor stream, pressurizing the once enriched stream to form a pressurized enriched stream, partially vaporizing the pressurized enriched stream in a second heat exchange unit using heat from a cooled external heat source stream to form a partially vaporized enriched stream and a spent external heat source stream, separating the partially vaporized enriched stream in a first separator to form the third saturated vapor stream and a first lean liquid stream, fully vaporizing and superheating the third saturated vapor stream in a third heat exchange unit to form the fully vaporized and superheated third saturated vapor stream, reducing the pressure of the first lean liquid stream via a first throttle valve to form a first reduced pressure mixed liquid-vapor stream, feeding the first reduced pressure mixed liquid-vapor stream into a third separator to form the first saturated vapor stream and a third lean liquid stream, and reducing the pressure of the third lean liquid stream via a third throttle valve to form the third reduced pressure mixed liquid-vapor stream, where all of the stream are derived form a multi-component working fluid.

2. The method of claim 1, further comprising:

prior to partially vaporizing the pressurized enriched stream, mixing the once enriched stream with a second saturated vapor stream to form a twice enriched stream, where the once enriched stream fully absorbs the second saturated vapor stream, and pressurizing the twice enriched stream to form the pressurized enriched stream, feeding the first reduced pressure mixed liquid-vapor stream into second separator to form the second saturated vapor stream and a second lean liquid stream, reducing the pressure of the second lean liquid stream via a second throttle valve to form a second reduced pressure mixed liquid-vapor stream, and feeding the second reduced pressure mixed liquid-vapor stream into the third separator to form the first saturated vapor stream and the third lean liquid stream.

3. The method of claim 1, wherein the working fluid comprises:

a multi-component fluids including at least one lower boiling point component, the lower boiling components, and at least one higher boiling point component, the higher boiling components.

4. The method of claim 3, wherein the multi-component fluids comprise:

an ammonia-water mixture, a mixture of two or more hydrocarbons, a mixture of two or more freon, or a mixture of hydrocarbons and freon.

5. The method of claim 3, wherein the multi-component fluids comprise:

mixtures of any number of components with favorable thermodynamic characteristics and solubility.

6. The method of claim 3, wherein the multi-component fluids comprise:

a mixture of water and ammonia.

7. An apparatus for implementing a thermodynamic cycle comprising:

a turbine expanding a fully vaporized and superheated third vapor stream, converting a portion of its thermal energy into a usable form energy to form a low pressure spent stream, a first mixing valve for mixing the spent stream with a third reduced mixed liquid-vapor stream to form a basic solution stream, a condenser or first heat exchange unit for condensing the basic solution stream using an external coolant to form a fully condensed basic solution stream, a first pump for pressurizing the fully condensed basic solution stream to form a pressurized basic solution stream, a second mixing valve for mixing the pressurized basic solution stream with a first saturated vapor stream to form a first or once enriched stream, where the pressurized basic solution stream fully absorbs the once saturated vapor stream, a second pump for pressurizing the once enriched stream to form a pressurized enriched stream, a second heat exchange unit for partially vaporizing the pressurized enriched stream using heat from a cooled external heat source stream to form a partially vaporized enriched stream and a spent external heat source stream, a first separator for separating the partially vaporized enriched stream to form the third saturated vapor stream and a first lean liquid stream, a third heat exchange unit for fully vaporizing and superheating the third saturated vapor stream to form the fully vaporized and superheated third vapor stream, a first throttle valve for reducing the pressure of the first lean liquid stream to form a first reduced pressure mixed liquid-vapor stream, a third separator into which the first reduced pressure mixed liquid-vapor stream is fed to form the first saturated vapor stream and a third lean liquid stream, and a third throttle valve for reducing the pressure of the third lean liquid stream to form the third reduced pressure mixed liquid-vapor stream, where all of the stream are derived form a multi-component working fluid.

8. The apparatus of claim 7, further comprising:

a third mixing valve for, prior to partially vaporizing the pressurized enriched stream, mixing the once enriched stream with a second saturated vapor stream to form a twice enriched stream, where the once enriched stream fully absorbs the second saturated vapor stream, and a third pump for pressurizing the twice enriched stream to form the pressurized enriched stream, a second separator into which the first reduced pressure mixed liquid-vapor stream is fed to form the second saturated vapor stream and a second lean liquid stream, a second throttle valve for reducing the pressure of the second lean liquid stream to form a second reduced pressure mixed liquid-vapor stream, and a third separator into which the second reduced pressure mixed liquid-vapor stream is fed to form the first saturated vapor stream and the third lean liquid stream.

9. The apparatus of claim 7, wherein the working fluid comprises:

a multi-component fluids including at least one lower boiling point component, the lower boiling components, and at least one higher boiling point component, the higher boiling components.

10. The apparatus of claim 9, wherein the multi-component fluids comprise:

an ammonia-water mixture, a mixture of two or more hydrocarbons, a mixture of two or more freon, or a mixture of hydrocarbons and freon.

11. The apparatus of claim 9, wherein the multi-component fluids comprise:

mixtures of any number of components with favorable thermodynamic characteristics and solubility.

12. The apparatus of claim 9, wherein the multi-component fluids comprise:

a mixture of water and ammonia.

13. A skid apparatus for implementing a thermodynamic cycle comprising:

a skid on which is mounted a turbine unit T1, three heat exchange units HE1, HE2 and HE3, three gravity separators S1, S2, and S3, four fluid connectors C1, C2, C3 and C4, one electrical connection E1, three pumps P1, P2, and P3, one water pump wP, one air fan aF, three mixing valve M1, M2 and M3, three throttle valve TV1, TV2, and TV3, and one two way valve V0, six three way valves V1, V2, V3, V4, VV65 and V6 and piping interconnecting the various components, where:

a turbine outlet is connected to the third mixing value M3 and includes the electric connector E1, the third mixing value M3 is connected to the third throttle valve TV3 and a first heat exchange unit inlet, the third throttle valve TV3 is connected to a bottom port of the first separator S1, a first heat exchange unit outlet is connected to the first pump P1 and then to the first mixing valve M1, the first mixing valve M1 is connect to a top port of the third separator S3 and to the first three way valve V1, the first three way valve V1 is connected to the second three way valve V2 and the second pump P2, the second three way valve V2 is connected to the second pump P2 and the second mixing valve M2, the second mixing valve M2 is connected to the one way valve V0 and the third pump P3, the one way valve V0 is connected to a top port of the second separator S2, the pump P3 is connected to a second heat exchange unit inlet, a second heat exchange unit outlet is connected to a middle port of the first separator S1, a top port of the separator S1 is connected to a third heat exchange unit inlet, a bottom port of the separator S1 is connected to a fourth three way valve V4, a third heat exchange unit outlet is connected to a turbine inlet, the fourth three way valve V4 is connected to the second throttle valve TV2 and to the third three way valve V3, the second throttle valve TV2 is connected to a middle port of the second separator S2, the third three way valve V3 is connected to a bottom port of the second separator S2 and the first throttle valve TV1, and the first throttle valve TV1 is connected to a middle port of the first separator S1, and where the valves are adapted to permit the apparatus to enrich the upcoming stream one or two time using vapor streams from the third and second separators S3 and S2, and where the streams flowing through the piping and components of the apparatus are derived from a multi-component working fluid, and where the first and sixth valve V5 and V6 are adapted to permit the apparatus to use either water or air as the external coolant.

14. The apparatus of claim 12, wherein the working fluid comprises:

a multi-component fluids including at least one lower boiling point component, the lower boiling components, and at least one higher boiling point component, the higher boiling components.

15. The apparatus of claim 13, wherein the multi-component fluids comprise:

an ammonia-water mixture, a mixture of two or more hydrocarbons, a mixture of two or more freon, or a mixture of hydrocarbons and freon.

16. The apparatus of claim 13, wherein the multi-component fluids comprise:

mixtures of any number of components with favorable thermodynamic characteristics and solubility.

17. The apparatus of claim 13, wherein the multi-component fluids comprise:

a mixture of water and ammonia.

18. A skid apparatus for implementing a thermodynamic cycle comprising:

a vaporizing and superheating subunit including heat exchanges units HE2 and HE3 and the fluid connectors C1 and C2 and associated piping mounted on a first skid, a separation subsystem including the three separators S1, S2, and S3, the three throttle valve TV1, TV2 and TV3, the pumps P1, P2, and P3, the valves V0, V1, V2, V3 and V4, and the mixing valves M1, M2 and M3 and associated piping mounted on a second skid, a turbine subsystem including a turbine T1, the electrical connector E1 and associated piping and electric cables mounted on a third skid, a condenser subsystem including the condenser HE1, the valves V5 and V6, the water pump wP and the air fan aF and associated piping mounted on a fourth skid, where the skids are adapted to be interconnected to form a complete system and where the condenser subsystem includes the two valves V5 and V6, the water pump wP and the air fan aF so that the apparatus can use either water or air as the coolant, and where:

a turbine outlet is connected to the third mixing value M3 and includes the electric connector E1, the third mixing value M3 is connected to the third throttle valve TV3 and a first heat exchange unit inlet, the third throttle valve TV3 is connected to a bottom port of the first separator S1, a first heat exchange unit outlet is connected to the first pump P1 and then to the first mixing valve M1, the first mixing valve M1 is connect to a top port of the third separator S3 and to the first three way valve V1, the first three way valve V1 is connected to the second three way valve V2 and the second pump P2, the second three way valve V2 is connected to the second pump P2 and the second mixing valve M2, the second mixing valve M2 is connected to the one way valve V0 and the third pump P3, the one way valve V0 is connected to a top port of the second separator S2, the pump P3 is connected to a second heat exchange unit inlet, a second heat exchange unit outlet is connected to a middle port of the first separator S1, a top port of the separator S1 is connected to a third heat exchange unit inlet, a bottom port of the separator S1 is connected to a fourth three way valve V4, a third heat exchange unit outlet is connected to a turbine inlet, the fourth three way valve V4 is connected to the second throttle valve TV2 and to the third three way valve V3, the second throttle valve TV2 is connected to a middle port of the second separator S2, the third three way valve V3 is connected to a bottom port of the second separator S2 and the first throttle valve TV1, and the first throttle valve TV1 is connected to a middle port of the first separator S1, and where the valves are adapted to permit the apparatus to enrich the upcoming stream one or two time using vapor streams from the third and second separators S3 and S2, and where the streams flowing through the piping and components of the apparatus are derived from a multi-component working fluid, and where the first and sixth valve V5 and V6 are adapted to permit the apparatus to use either water or air as the external coolant.

19. The apparatus of claim 18, wherein the working fluid comprises:

a multi-component fluids including at least one lower boiling point component, the lower boiling components, and at least one higher boiling point component, the higher boiling components.

20. The apparatus of claim 19, wherein the multi-component fluids comprise:

an ammonia-water mixture, a mixture of two or more hydrocarbons, a mixture of two or more freon, or a mixture of hydrocarbons and freon.

21. The apparatus of claim 19, wherein the multi-component fluids comprise:

mixtures of any number of components with favorable thermodynamic characteristics and solubility.

22. The apparatus of claim 19, wherein the multi-component fluids comprise:

a mixture of water and ammonia.

* * * * *